United States Patent [19]

Valpey

[11] 4,099,224

[45] Jul. 4, 1978

[54] SNAP ON CONNECTION AND RELEASE MEANS BETWEEN LIGHTGLOBE AND FIXTURE

[76] Inventor: Lucy Latham Valpey, 11180 Enchanta Vista, San Jose, Calif. 95127

[21] Appl. No.: 750,619

[22] Filed: Dec. 15, 1976

[51] Int. Cl.[2] ..... F21V 17/06; F21V 17/00

[52] U.S. Cl. ..... 362/433; 362/440; 362/453

[58] Field of Search ..... 240/128, 134, 136, 149; 362/433, 434, 440, 442, 453

[56] References Cited

U.S. PATENT DOCUMENTS

| | | | |
|---|---|---|---|
| 1,029,356 | 6/1912 | Frederick | 240/134 |
| 1,225,700 | 5/1917 | Collins | 240/134 |
| 1,453,099 | 4/1923 | Euphrat | 240/134 |
| 2,038,815 | 4/1936 | Wendt | 240/128 |
| 3,231,734 | 1/1966 | Stiffel | 240/128 X |

*Primary Examiner*—Fred L. Braun

*Attorney, Agent, or Firm*—Leslie M. Hansen

[57] ABSTRACT

A quick connect and release device between an electric light fixture and a light diffusing shade or globe therefor including snap-on resilient fingers on the fixture engageable in an annular groove in the globe as well as cam members on the globe registerable with the resilient fingers upon turning of the globe relative to the fixture to free the globe for removal therefrom.

2 Claims, 10 Drawing Figures

SNAP ON CONNECTION AND RELEASE MEANS BETWEEN LIGHTGLOBE AND FIXTURE

BACKGROUND OF THE INVENTION

This invention relates to means for securing a light deffusing globe to a lamp fixture and for releasing the same in a simple yet effective manner.

The most simple and conventional securing and releasing means between a ceiling fixture and light deffusing globe or shade consists of an annular groove formed on the open upper rim of a light globe or shade adapted to fit into the annular open lower rim of the ceiling fixture and at least three thumb screws threadedly extending through the annular rim with their inner ends disposed to extend radially into the annular groove of the light deffusing globe or shade. This form of securing means is the most universally accepted and available means in the lighting fixture art and has been so for many years even back into the gas-light era.

While the prior known form of connector is economical and effective for securing light globe shades to a ceiling fixture it requires that a person stand on a step ladder or the like to reach the thumb screws, manipulate them one at a time in order to either secure or release the two elements relative to each other.

In 1957 P. Kaufman was granted U.S. Pat. No. 2,810,824 disclosing spring loaded pins in place of threaded thumb screws. In this form of releasable fastening means the pins must be provided with some element exteriorly of the ceiling fixture to withdraw the spring loaded pins from engagement with the annular groove in the glass globe shade. Moreover, all three pins cannot be withdrawn simultaneously but must be locked in withdrawn position one at a time in order to free the glass globe for removal from the fixture.

The present invention seeks to overcome the foregoing complicated spring loaded and latcheable pin arrangement and to make it more convenient for a person to attach and to remove the light globe relative to the ceiling or lamp fixture.

STATEMENT OF THE PRESENT INVENTION

It is an object of the present invention to provide a simple yet effective securing means between a light globe shade and a lamp or ceiling fixture.

It is another object to provide a self releasable fastening means between a ceiling fixture and a light globe shade. This object contemplates built-in means between the ceiling fixture and light globe by which latch means on the ceiling fixture automatically snaps into locking engagement in the annular groove in the light globe during assembly and in which means arranged on the light globe in staggered relation to the latch means on the ceiling fixture will upon movement relative thereto register therewith simultaneously to release the latch means from locking position within the annular groove in the light globe.

These and other objects and advantages of the present invention will become apparent from a reading of the following description and claims in the light of the accompanying single sheet of drawing in which:

GENERAL DESCRIPTION

Figure 1:
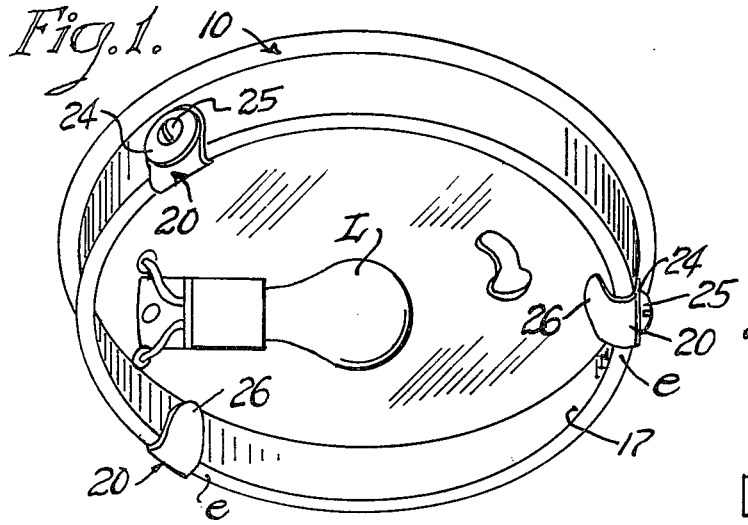
FIG. 1 is a perspective view of a ceiling fixture as seen from below.
Figure 2:
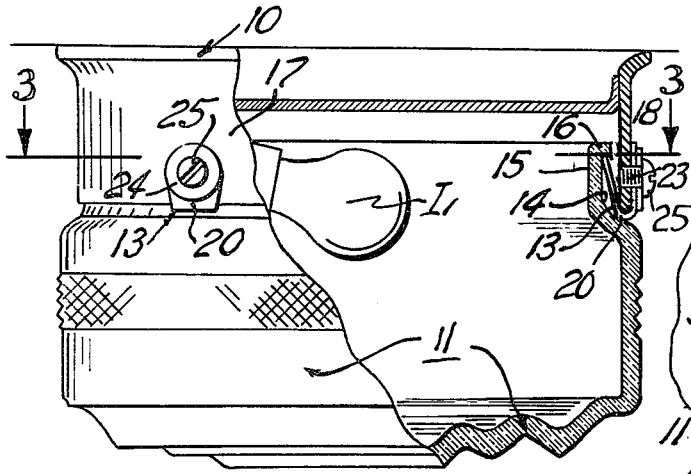
FIG. 2 is a side elevation of the ceiling fixture of FIG. 1 with a light globe secured in place thereon, the assembly being broken away and shown partly in section.

Referring to FIGS. 1 and 2 in the drawing, a ceiling fixture 10 is shown adapted to receive, sleeve fashion, a light diffusing globe or shade 11 in a conventional manner to cover the electric light Lamp L usually mounted on the ceiling fixture.

Means 13 for securing the light globe 11 to the ceiling fixture 10 includes an annular groove 14 formed in the open upper neck 15 of the globe 11 and just below an annular lip or rim bead 16 forming an outwardly projecting upper boarder of the annular groove 14 in the exterior facade of the neck 15 of the light globe 11. The means 13 for securing the light globe to the ceiling fixture also includes an plurality of elements 13′ equally spaced from each other about the annular sleeve—like portion 17 of the ceiling fixture 10 and disposed to extend inwardly therefrom into the annular groove 14 for engagement with the lip or rim bead 16 of the light globe to keep the globe 11 from slipping out of the sleeve-like portion 17 of the ceiling fixture 10.

As previously pointed out in the background of the invention it was heretofore the custom to provide the elements 13′ in the form of a screw or a pin movable radially inward and outward relative to the sleeve-like portion 17 of the ceiling fixture. The most common form of such pin type element was a threaded thumb screw passing radially through a threaded bore 18 in the cylindrical sleeve-like portion 17 so that the inner end of such screw engaged in the groove 14 formed in the light globe as a part of the securing means 13.

DETAILED DESCRIPTION OF THE INVENTION

In accordance with the present invention the securing means 13 comprises in addition to the annular groove 14 in the light globe 11 a yieldable finger or tab 20 secured in spaced relation to the cylindrical shell portion 17 of the ceiling fixture 10 in each of the positions heretofore occupied by the screw elements 13′.

Figure 8:
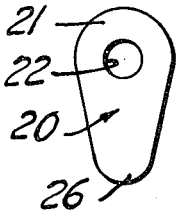
FIG. 8 is a plan view of one of the latching fingers in the embodiment of the present invention.

The tabs 20 as shown in FIG. 8 are flat metal tabs of flexible material having a mounting zone 21 provided with a bored opening 22 adapted to receive the threaded shank 23 of a replacement for the screw elements 13′. The screw shank 23 is adapted to have a washer 24 thereon against an enlarged head 25 which is slotted for fastening by means of a screw driver and the like. The mounting zone 21 of the tabs 20 is placed against the outside of the cylindrical sleeve portion 17 and the threaded shank portion 23 which passes through the washer and zone 21 of the tab 20 is of such a limited length as to fit only into the threaded bore 18 in the wall of the cylindrical sleeve 17.

Figure 5:
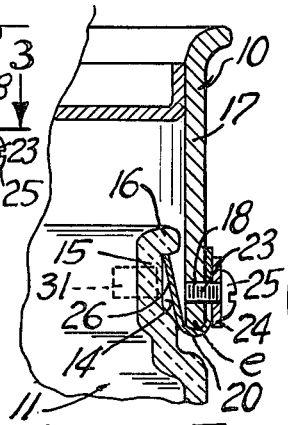
FIG. 5 is a vertical section taken along line 5—5 therein and showing the latching means as in FIG. 2 at larger scale.
Figure 4:
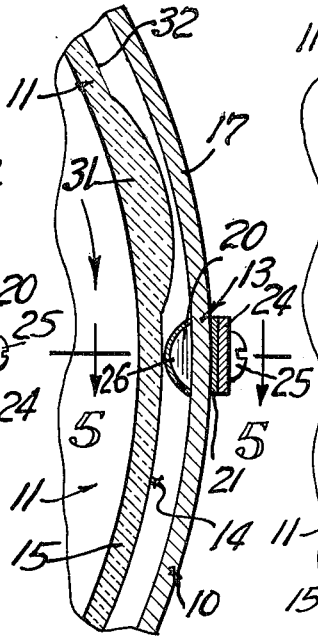
FIG. 4 is an enlarged fragmentary segment of FIG. 3.

As best illustrated in FIGS. 1, 2 and 5 the free end 26 of the tab 20 while normally extending beyond the lower edge—*e*—of the cylindrical sleeve 17 is bent back upon itself so that the free end 26 extends back toward the inner face of the wall of the cylindrical sleeve 17. As best seen in FIGS. 1, 2 and 4 the free end 26 of the tab 20 is out of parallel with the cylindrical sleeve 17 and extends at an angle upwardly and inwardly radially of the open end—*e*—of the sleeve 17.

The tabs 20 are equally spaced about the periphery of the cylindrical sleeve 17 and are preferably three in number. The inturned free ends 26 of these tabs are resilient, i.e. spring-like in action such that when the rim bead 16 of the light globe 11 is forced upwardly into the cylindrical sleeve 17 these resilient tab ends 26 yield and are flexed outwardly by the rim bead 16. However, as soon as the rim bead 16 passes the extreme ends of the tab ends 26 the latter return by their own resiliency into the annular groove 14 of the light globe 11 to engage beneath the rim bead of the latter. The light globe 11 is thus secured relative to the ceiling fixture by the securing means 13 of the present invention.

Figure 7:
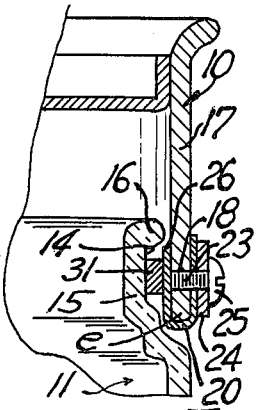
FIG. 7 is a section similar to that of FIG. 5 but taken along line 7—7 in FIG. 6 to illustrate the release feature.
Figure 6:
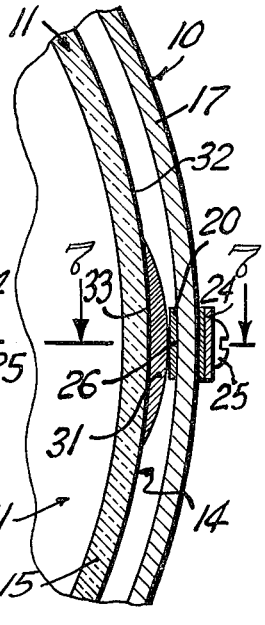
FIG. 6 is a section similar to that of FIG. 4 to illustrate the release feature of the latching means of this invention.

The securing means of the present invention also includes means 30 for releasing the same to enable withdrawal of the rim bead 16 and neck end 15 of the light globe 11 from the ceiling fixture 10. The means 30 comprises a cam lug 31 formed on the peripheral face 32 of the annular neck 15 and groove 14 in the light globe. There is one such cam lug 31 for each tab 20 and they are equally spaced about the annular neck 15 and groove 14 identically as the spacing of the tabs 20 about the cylindrical sleeve 17. The cam lugs 31 are normally disposed out of register with respect to the tabs 20 when the light globe 11 is attached to the ceiling fixture as above explained. The several cam lugs 31 serve as a releasing means upon rotation of the light globe 11 relative to the fixture 10 to move the cam lugs 31 into register with the inwardly projecting ends 26 of the tabs 20. In this manner all the securing tabs 26 are simultaneously pressed outwardly by the camming action of the respective cam lugs 31. When the several tab ends 26 become aligned with the inner wall of the cylindrical sleeve 14 as illustrated in FIGS. 6 and 7, the annular rim bead 16 on the globe 11 can clear the free ends 26 of all tabs 20 and be withdrawn, i.e., lowered out of open lower end of the ceiling fixture 10.

Figure 9:
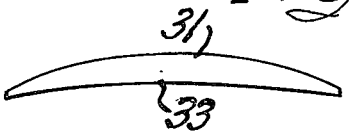
FIG. 9 is a horizontal plan view of a cam means serving as a release means in the embodiment of the present invention.
Figure 10:
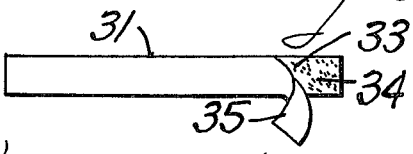
FIG. 10 is an inside elevation of the mounting side of the cam means shown in FIG. 9.

For purposes of the present disclosure the cam means 31 has been shown in either of two forms. In one form and for converting a conventional light diffusing globe 11 into one having such cam release means 30, the latter is shown in FIGS. 6, 9 and 10 as an applique. The form shown in FIG. 4 shows the cam lug as an integral part of and molded with the glass or plastic transparent material from which the globe 11 is made.

Figure 3:
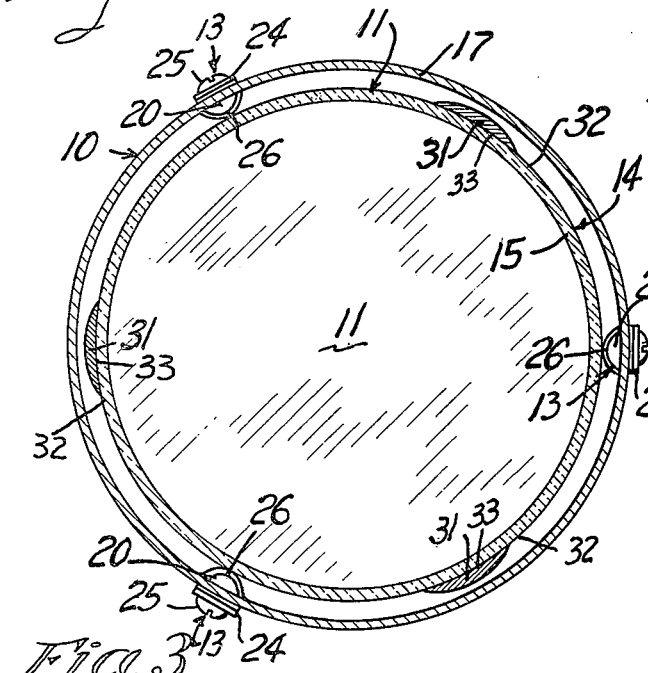
FIG. 3 is a horizontal section through the assembly of FIG. 2 and taken along line 3—3 therein.

The applique forms of FIGS. 9 and 10 includes a segmental arcuate surface 33 having an adhesive coating 34 thereon and covered by a tear strip 35. The applique type lugs 31 are applied by removal of the tear strips 35 therefrom and the adhesion of the adhesive coating 34 and the surface 33 pressed against the peripheral face 32 in the groove 14 of the globe at the necessarily spaced locations as shown in FIG. 3.

In either event the cam lugs 31 function as a releasing means 30 when cammingly engaged with the resilient tips or ends 26 of the tabs 20. In this connection it will be appreciated that the tabs ends 26 may be formed as an integral part of the cylindrical sleeve 14 as an inwardly projecting resilient securing means.

By the foregoing arrangements the attachment and removal of the light diffusing globe relative to the ceiling fixture can be accomplished easily and quickly without the need of tools or the separate release of each securing means from latching engagement with the annular groove in the light globe. The attachment is accomplished by merely pressing the rimmed neck end of the light globe up into the open lower end of the cylindrical sleeve portion 17 of the ceiling fixture 10 until the several resilient tab ends 26 snap back into position within the annular groove 14 to engage under the rim bead 16.

To remove the light globe 11 one need only turn the latter relative to the cylindrical sleeve 17 of the ceiling fixture until the camming action of the several cam lugs 31 against the several resilient tab ends 26 simultaneously frees the globe 11 for withdrawal from the ceiling fixture.

Having thus described my new snap on securing means and cam release means between a ceiling fixture and a light globe shade in specific detail it will be appreciated by those skilled in the art that the same may be altered, varied or modified without departing from the spirit or scope of my invention therein as called for in the appended claims.

What I claim as new and desire to protect by Letters Patent is:

1. In combination with a conventional electric lamp fixture having an open ended globe receiving cylindrical sleeve portion including a plurality of threaded bores formed radially therethrough and a light diffusing globe having an open ended annular portion boardered by an outwardly projecting rim bead insertable into the open ended cylindrical sleeve portion for connection therewith; and means for releasably securing such light diffusing globe relative to such lamp fixture comprising:

(1) a plurality of resilient flat metal latching tabs arranged in spaced relation about the cylindrical sleeve portion of such lamp fixture, said latching tabs each including a mounting zone at one end provided with a bored opening registerable with a threaded bore in the sleeve portion of the lamp fixture;

(2) a headed bolt having a screw shank extending through the bored opening in the mounting zone of each said tab for threaded connection with a respective threaded bore in the sleeve portion of the lamp fixture for securing said tab thereto;

(3) each said resilient tab having its free end opposite its mounting zone bent back upon itself about the free edge of the sleeve portion of the lamp fixture and extending at an angle inwardly therefrom for yieldable engagement by the outwardly projecting rim bead on the open ended neck of the light diffusing globe as it is inserted into the sleeve portion of the lamp fixture for securing the light diffusing globe to the lamp fixture; and (4) a plurality of applique type cam release means arranged on and about the annular portion of a conventional light diffusing globe and secured thereto adjacent the rim bead boarder thereof in spaced relation comparable to that of said resilient tabs for simitaneously registering with and cammingly urging said resilient tabs out of engagement with the rim head of the globe upon turning of said light globe relative to the light fixture.

2. The means for securing and releasing the light diffusing globe relative to the lamp fixture in accordance with that of claim 1 in which said applique type cam lugs each comprises:

(1) an independent segmental cam body having an arcuate surface conforming to the peripheral facade of the neck portion of the light diffusglobe; and (2) means for adhesively securing each of said segmental cam bodies to the neck portion of the light diffusing globe in spaced relation about the periphery thereof for simultaneously registering with said plurality of resilient tabs upon turning of the light globe relative to the lamp fixture.

* * * * *